United States Patent [19]

Brando et al.

[11] Patent Number: 4,989,419

[45] Date of Patent: Feb. 5, 1991

[54] CHILL-RETENTION FOOD SERVICE TRAY

[75] Inventors: Michael Brando, Chicago; Anthony E. Fiello, Bensenville, both of Ill.

[73] Assignee: Branello Industries, Inc., Bensenville, Ill.

[21] Appl. No.: 535,322

[22] Filed: Jun. 8, 1990

[51] Int. Cl.[5] ..... F25D 3/08

[52] U.S. Cl. ..... 62/457.2; 62/457.6

[58] Field of Search ..... 62/457.2, 457.6, 371

[56] References Cited

U.S. PATENT DOCUMENTS

| | | | |
|---|---|---|---|
| D. 286,124 | 10/1986 | Dempsey | D7/2 |
| D. 297,897 | 10/1988 | Stackhouse | D7/2 |
| 1,906,815 | 5/1933 | Schlumbohm . | |
| 2,810,276 | 10/1959 | Murray . | |
| 3,286,483 | 11/1968 | Burg | 62/371 |
| 3,383,880 | 5/1968 | Peters | 62/457.6 |
| 3,859,819 | 1/1975 | Kaplan | 62/371 |
| 4,304,106 | 12/1981 | Donnelly | 62/457.6 |
| 4,357,809 | 11/1982 | Held et al. | 62/457.3 |
| 4,488,817 | 12/1984 | Uesaka et al. | 366/149 |
| 4,691,664 | 9/1987 | Crowell | 119/61 |

OTHER PUBLICATIONS

Polyfoam Packers Corporation, "Insulated Transporters with Durable Nylon Coverings", © 1987, 2 pp.

*Primary Examiner*—Lloyd L. King

*Attorney, Agent, or Firm*—Kinzer, Plyer, Dorn, McEachran & Jambor

[57] ABSTRACT

A chill-retention food service tray, capable of keeping its contents chilled for an extended time (e.g., several hours) in a warm environment, comprises a bottom tray member including a bottom panel having an upwardly projecting peripheral rim wall and a plurality of upwardly projecting stiffening ribs onto which a top tray member fits; the top tray member includes a support panel at the upper level of the reinforcing ribs and a peripheral rim wall engaging and adhesively secured to the bottom rim wall, as well as a closed configuration hollow wall defining a cup for a dip, sauce, or the like. The two tray members conjointly define a chamber filled with a various chilling gel; the gel has a high heat of fusion. A plurality of removable divider members may divide the top panel support surface, around the cup, into a series of storage compartments.

27 Claims, 3 Drawing Sheets

Fig. 7.
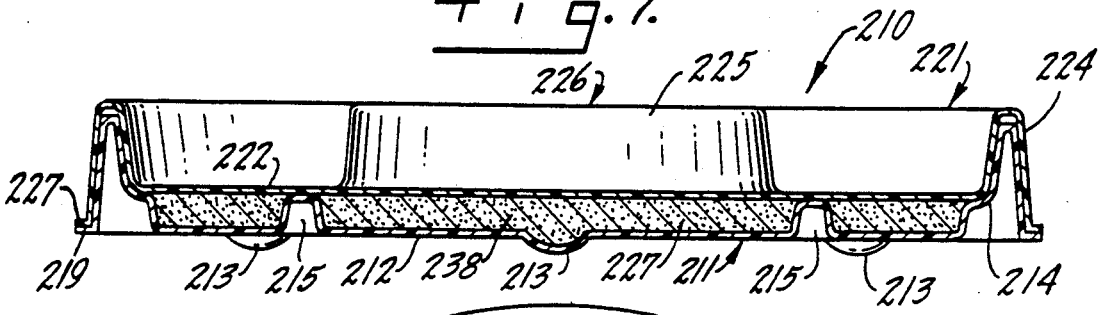
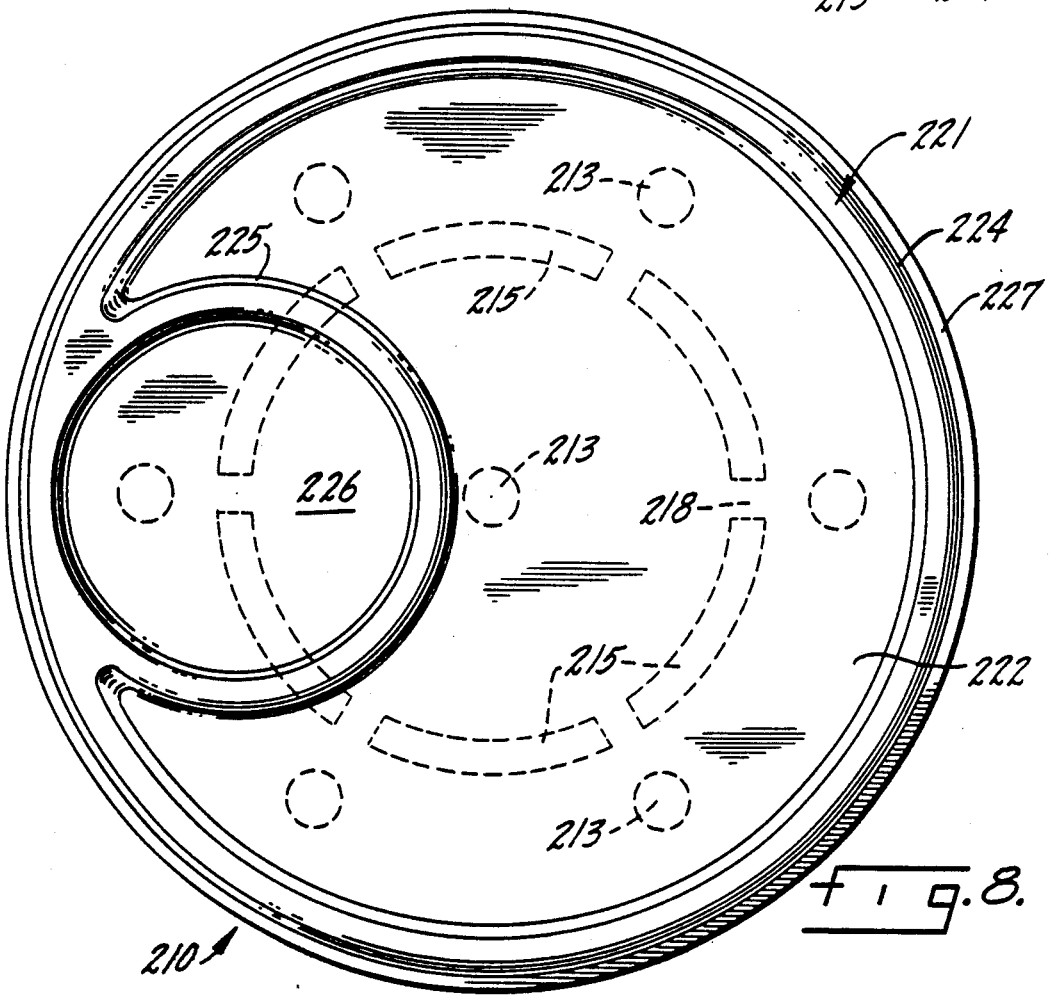
Fig. 8.
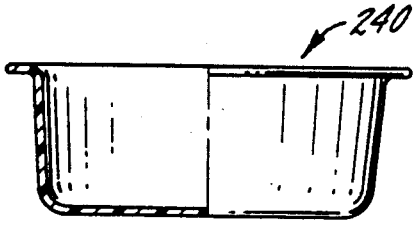
Fig. 9.

CHILL-RETENTION FOOD SERVICE TRAY

BACKGROUND OF THE INVENTION

The service of foods of various kinds that are supposed to be chilled when consumed presents substantial problems. Even in an ideal environment, such as a private home or a small restaurant, it may be necessary to keep foods of this kind chilled for extended periods after they have been removed from normal refrigeration facilities and set out in display for the people who are to eat them. The larger the restaurant or other food service facility, or the more extended its hours, the greater the problems become. For a catering service that prepares cold food in advance and must deliver that food for consumption at varying distances, the problems are even worse. In all of these different environments, there is a substantial tendency for the originally chilled food to warm up, once it is out into a warm environment, with consequent wilting and loss of the desired taste and texture characteristics for the food.

One conventional technique for serving chilled foods, frequently utilized in restaurants and similar environments, uses a large tube or trough filled with ice cubes or chipped ice; the dishes containing the chilled food that is to be served to the patrons are inserted into the ice and are kept chilled for varying periods of time after they have been brought from the normal refrigeration facilities. A system of this kind frequently requires periodic replenishment of the ice and may require draining of the water from melting of the ice. Serving dishes for domestic use and other applications have been constructed on the same principle, usually with a hollow base for storing a supply of ice cubes or chipped ice.

Another technique used in the service of chilled foods, most frequently in a catering situation, utilizes small plastic bags or other containers of a chilling gel. These gel-filled containers are frozen, in much the same manner as the freezing of ice, and are then packed around the food or liquids to be served cold, in much the same way as ice cubes. This arrangement has the advantage that the water associated with melting ice is eliminated but is frequently at a disadvantage with respect to cost, particularly if recovery of the gel-filled plastic bags or other containers is difficult. Finally, there have been some proposals for specialized dishes for maintaining food, condiments, or the like in chilled condition for extended periods, these containers usually including one or more chambers filled with a chillable gel of the same kind as has been used in the aforementioned gel-filled plastic bags.

The previously known arrangements for service of chilled foods and the like have all presented continuing problems and difficulties pertaining to manufacture and use. The special dishes incorporating chilling gels have not been adapted to general food service and have frequently been unduly expensive for ordinary usage. Many of these dishes tend to produce excessive condensation. In many instances, the service arrangements and apparatus for chilled foods do not maintain the foods at a low enough temperature for a long enough period to meet the requirements of restaurant and catering use, or even to fulfill the requirements of family use where the time of service must be adjusted to meet the needs of different people. Moreover, these previously known service arrangements for chilled foods have tended to be limited to one or two specific uses and have lacked the versatility necessary for use with a broad variety of foods, condiments and the like.

SUMMARY OF THE INVENTION

It is a principal object of the present invention, therefore, to provide a new and improved chill-retention service tray capable of keeping its contents chilled for an extended period of time (e.g., several hours) in a warm environment, which service tray is simple to use yet effective in operation Another object of the invention is to provide a ne and improved chill-retention service tray for foods, condiments, and the like that is simple and inexpensive to manufacture, yet durable and highly versatile in use.

Accordingly, the invention relates to a chill-retention service tray capable of keeping its contents chilled for an extended time in a warm environment, comprising a bottom tray member including a bottom panel of given size and configuration, a bottom rim wall projecting upwardly from the periphery of the bottom panel, and at least one stiffening rib projecting upwardly to a predetermined level above a medial portion of the bottom panel; a top tray member interfits with and is affixed to the bottom tray member, the top tray member including a service support panel positioned immediately above the top of the stiffening rib, a top rim wall projecting upwardly above the service panel and engaging the bottom rim wall around the periphery of the two panels, and an internal wall, of closed configuration, projecting upwardly above the service panel. The top and bottom tray members define a gel chamber, between them; a chilling gel fills the main gel chamber, the chilling gel having a high heat of fusion and a viscosity high enough to limit the gel sloshing about in the service tray when warm, yet liquid enough to be poured into the gel chamber.

BRIEF DESCRIPTION OF THE DRAWINGS

FIG. 7 is a sectional elevation view of another embodiment of the invention;

FIG. 8 is a plan view of the chill-retention service tray illustrated in FIG. 7; and FIG. 9 is a detail view illustrating a removable cup usable in any of the embodiments of FIGS. 1–6.

DESCRIPTION OF THE PREFERRED EMBODIMENT

FIGS. 1–4 illustrate a chill-retention service tray 10, capable of keeping its contents chilled for an extended time in a warm environment, that constitutes a preferred embodiment of the present invention.

The chill-retention service tray 10 comprises a bottom tray member 11. The bottom tray member 11 may be formed of any one of a number of suitable resins, suitable for food service use and capable of withstanding reduced termperatures down to about −10° C.; polystyrene is preferred. The bottom tray member is usually formed by vacuum or extrusion molding. The thicknesses for the various parts of tray member 11 are not unduly critical; the principal requirement is that the tray member be thick enough so that the overall construction of service tray 10 will be strong and rigid enough to withstand regular use. Typically, the walls and other elements of tray member 11 may have a thickness of approximately 0.060 inch (0.15 cm).

Figure 2:
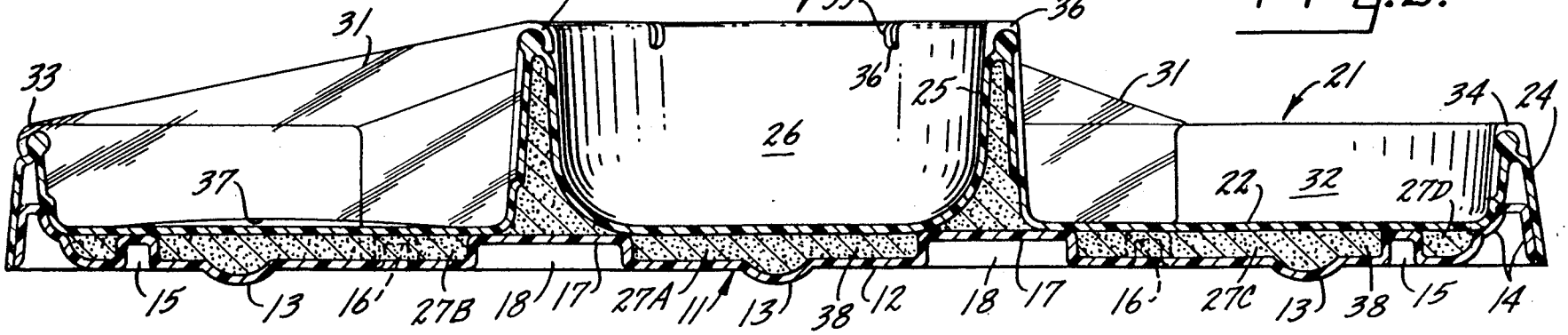
FIG. 2 is a sectional elevation view, on an enlarged scale, taken approximately as indicated by line 2—2 in FIG. 1.
Figure 4:
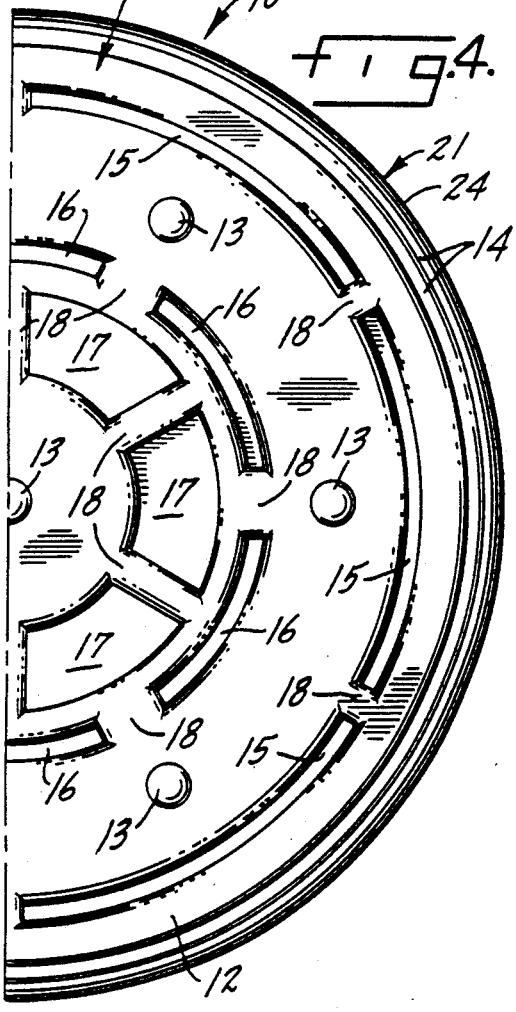
FIG. 4 is a bottom view of the tray of FIG. 1, showing one-half of the tray bottom.

Bottom tray member 11, FIGS. 2 and 4, includes a bottom panel 12 of given size and configuration. For service tray 10, the configuration is circular. Typically, panel 12 may have a diameter of approximately sixteen inches (41 cm). Bottom panel 12 (and tray 10) is preferably kept small enough so that it can fit into a freezer compartment of a domestic refrigerator, if the tray is to be sold for household use. Tray 10, and its bottom panel 11, may be made larger if intended for restaurant or other commercial use.

As shown in FIGS. 2 and 4, bottom panel 12 includes a plurality of support feet 13 and a bottom rim wall 14. In the cold-retention service tray 10, as best shown in FIG. 2, the bottom rim wall 14 is of hollow construction, being essentially of inverted U-shaped configuration. The bottom tray member 11, in addition to rim wall 14, includes a plurality of shorter inverted U-shaped reinforcing ribs, including the outer reinforcing ribs 15 and the inner stiffening ribs 16 shown in FIGS. 2 and 4. There are also a series of arcuate indentations 17 in the bottom tray member 11. The stiffening ribs 15 and 16 and the larger indentations 17 are all of uniform height, preferably about 0.375 inch (0.95 cm). In each series of the ribs and indentations 15–17, all are arcute, and each series is separated by intermediate channels 18, FIG. 4.

A second major component in the chill-retention service tray 10 is a top tray member 21 that is interfitted with and is affixed to the bottom tray member 11. The top tray member 21, like the bottom tray member, may be formed from any one of several suitable resins. Again, however, polystyrene is preferred. The top tray member may be formed by vacuum molding or by extrusion molding. As in the case of the bottom tray member, the wall thickness for top tray member 21 is not critical but should be sufficient so that the overall tray structure 10, when finished, is strong and stiff enough for its intended use. A typical wall thickness for top tray member is approximately 0.060 inch (0.15 cm).

Figure 1:
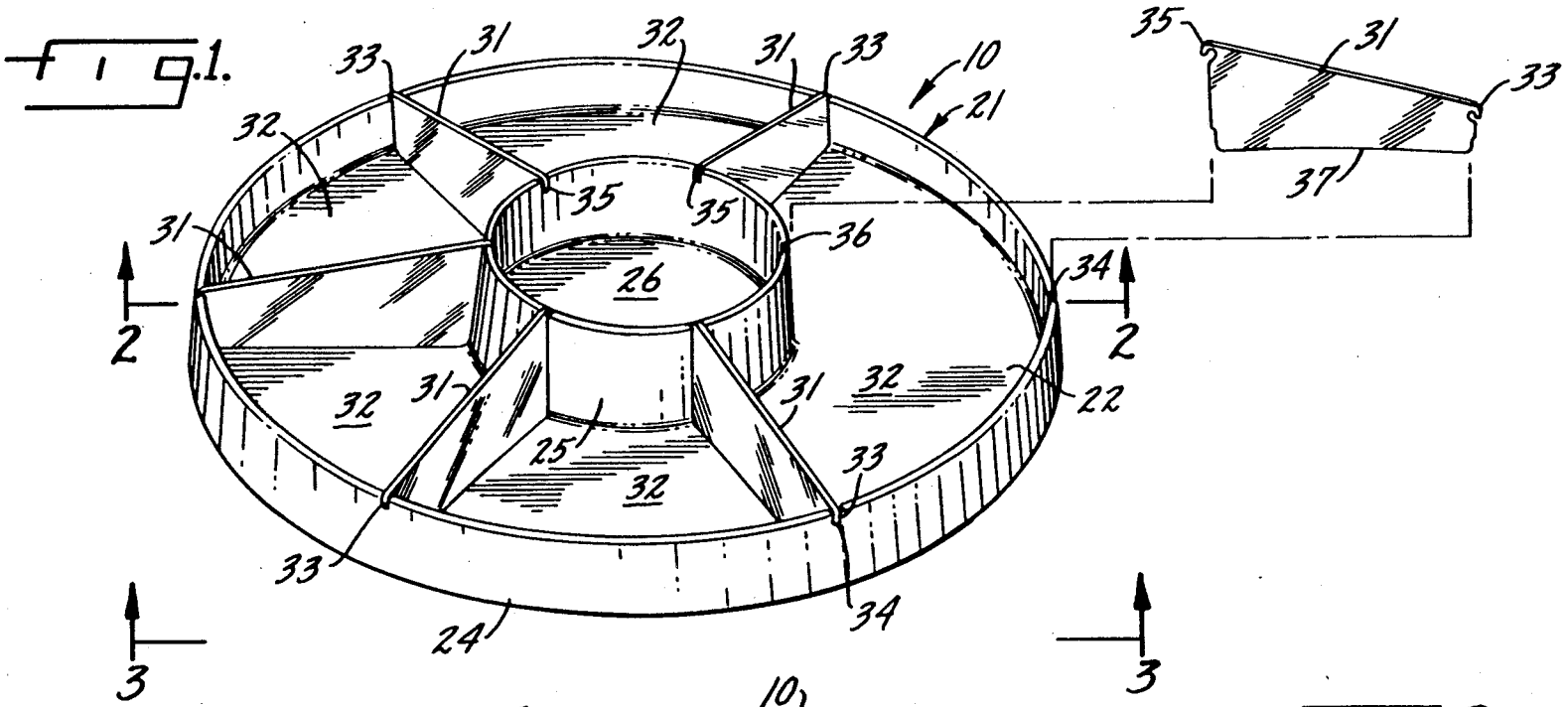
FIG. 1 is a perspective illustration of a chill-retention service tray according to a preferred embodiment of the present invention, with one divider member removed.

The top tray member 21 includes a top or service support panel 22, FIGS. 1 and 2, that is supported upon the upper surfaces of reinforcing ribs 15 and 16 and on the larger indentations 17 in bottom tray member 11, as best shown in FIG. 2. There is a top rim wall 24, formed integrally with panel 22, that projects upwardly above service panel 22, as a part of top tray member 21. The two rim walls 14 and 24 are in engagement around the peripheries of the two panels 12 and 22 of tray members 11 and 21; preferably, they are adhesively secured to each other. The upper tray member 21 further includes a hollow wall 25 disposed internally of the tray member. In the construction shown in FIGS. 1–3, the hollow wall 25 that is a part of tray member 21 is located in the center of service tray 10 and forms a central cup 26 for storage of a dip, sauce, condiment, or the like.

As best shown in FIG. 2, the two tray members 11 and 21, when assembled with each other, define a multi-segment main gel chamber between them. This gel chamber includes a central segment 27A below cup 26, a circular segment 27B between indentations 17 and reinforcing ribs 16, a wider circular segment 27C between ribs 16 and 15, and a rim segment 27D radially outwardly beyond reinforcing ribs 15. The segmented main gel chamber 27A–27D is filled with a chillable gel 38 having characteristics described more fully below. Gel 38 may fill the hollow wall 25 at the center of tray 10 when the gel is frozen.

Figure 3:
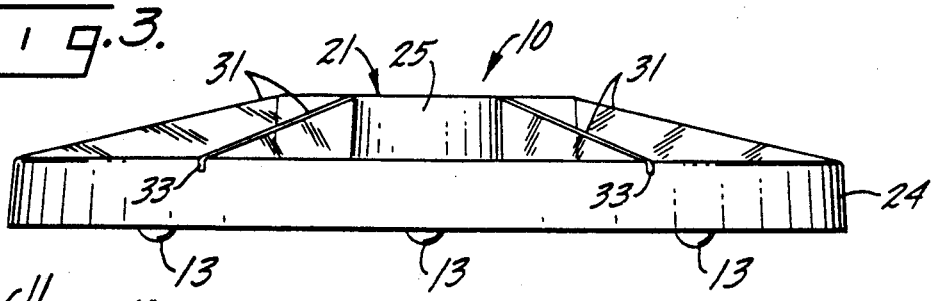
FIG. 3 is an elevation view taken approximately as indicated by line 3—3 in FIG. 1.

The chill-retention service tray 10 further includes a plurality of divider members 31 shown in FIGS. 1–3. Each divider 31 is a small, flat, resin panel, preferably transparent. As with the other resin components of tray 10, dividers 31 may be formed from any one of a number of different resins. Each divider member 31 extends across a portion of support panel 22 from internal wall 25 to the top rim wall 24. Thus, members 31 divide the space between internal wall 25 and top rim wall 24, on panel 22, into a series of storage compartments 32. In the illustrated construction for tray 10, when all of the dividers 31 are in place the space between walls 25 and 24, on support surface 22, is divided into six equal storage compartments 32. However, the individual dividers 31 are removable, as shown in FIG. 1, so that the number and configuration of the storage compartments can be changed as desired or required.

Each of the small individual resin panels constituting dividers 31 has two mounting means, 33 and 35, located at opposite ends of the top of the divider. As illustrated in FIGS. 1 and 2, each mounting means 33 and 35 is a hook-shaped projection, integral with the divider. These mounting hooks 33 and 35 are engageable in slots 34 and 36 in rim wall 24 and internal wall 25, respectively. That is, each pair of slots 34 and 36, one in the top rim wall 24 and the other in the internal wall 25, constitutes a pair of retainer means for receiving the mounting hooks on one of the dividers 31 to removably mount the divider in tray 10. In the preferred construction, the bottom surface 37 of each divider 31 (FIGS. 1 and 2) is slightly concave, with a large radius, to facilitate mounting and removal of the divider in the service tray.

The functional characteristics of the chilling 38 gel that fills chambers 27A–27D can be of appreciable importance in the use of cold-retention service tray 10. The chilling gel should have a high heat of fusion so that it can keep the tray contents chilled for an extended time, up to five hours, even though the tray may be located in a warm environment. Consequently, a water-base gel is preferred. Further, gel 38 should have a viscosity high enough so that it will not slosh about too much in service tray 10 when the tray is warm. Sloshing movement of the gel within the tray does not adversely affect its operation, but may be perceived as a disadvantage by some prospective purchasers. On the other hand, a gel that is fully "set" and generally solidified at room temperature is undesirable because it may not fill all of the tray chambers 27A–27D completely and cannot be conveniently incorporated in tray member 11 prior to final assembly with member 21.

As noted above, chilling gels have been known and used in applications similar to those in which the chill-retention service tray 10 would be employed. Generally speaking, however, previously used gels have not had the desired viscosity; that is, they may tend to flow too easily within a tray like tray 10 or may not flow at all. Further, using plain water or some known gels may produce problems with expansion, within the chambers of the tray, which could lead to damage of the tray with continued use.

A preferred formulation for the gel 38 filling chambers 27A–27D in tray 10 is a water based gel including a quantity of corn starch sufficient to afford a viscosity that precludes undue sloshing about of the gel within the tray, yet permits filling the tray by pouring the gel into tray member 11. On the other hand, other attributes are desirable in the gel; a preferred specific composition for gel 38 is:

TABLE 1

| Constituent | Minimum | Maximum |
|---|---|---|
| water | 75% | 85% |
| acrylic polymer | 1% | 5% |
| potassium sorbate | 1% | 5% |
| sodium tetraborate | 0.1% | 0.5% |
| carboxymethylcellulose | 1% | 5% |
| propylene glycol | 10% | 20% |
| cornstarch | 5% | 10% |
| triethanolamine | 1% | 5% |

In the foregoing list of constituents for the gel, all percentages are by weight.

Use of the chill-retention service tray 10, FIGS. 1–4 is quite simple. Prior to use, all of the partitions, dividers 31, are removed from the tray. Tray 10 is then placed in a freezer in horizontal position and chilled. Usually, three to four hours in the freezer is adequate to freeze gel 38, though this depends in part upon the temperature in the freezer and the gel composition. With a water base gel, as described above, some expansion occurs, so that a part of gel 38 is usually forced into the hollow wall 25 around cup 26.

For best results, the food to be served on tray 10 is pre-chilled. When the time for service comes the solid food (chips, vegetables, shrimp, crabmeat, cheese, fruit, crackers, etc.) is usually disposed in compartments 32. Any dip or relatively liquid food is usually deposited in cup 26. Tray 10 can then be set out and will keep the food chilled for an extended period, up to five hours, even though in a relatively warm environment.

Figure 6:
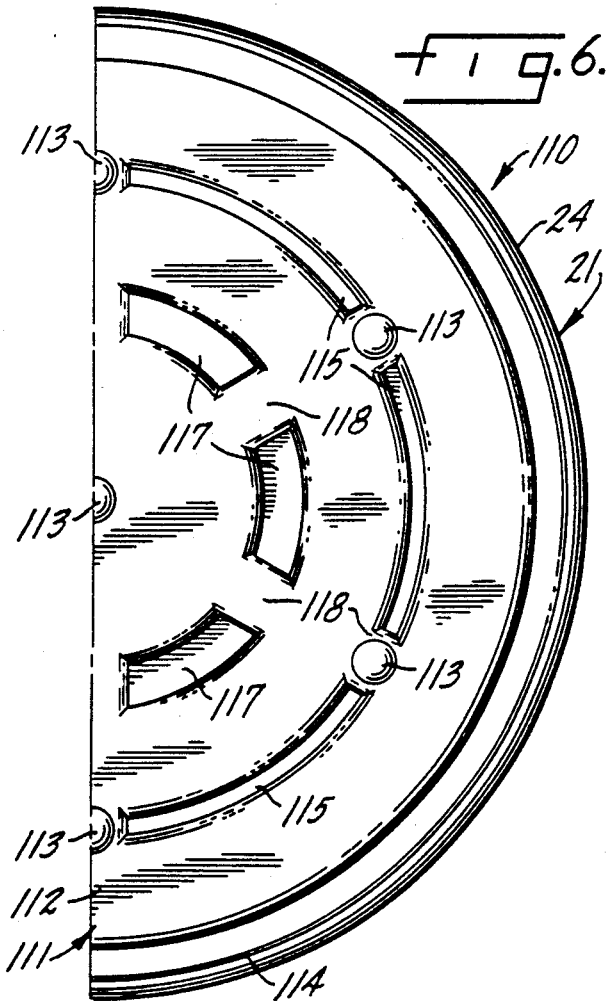
FIG. 6 is a bottom view, like FIG. 4, but illustrating the tray of FIG. 5.
Figure 5:
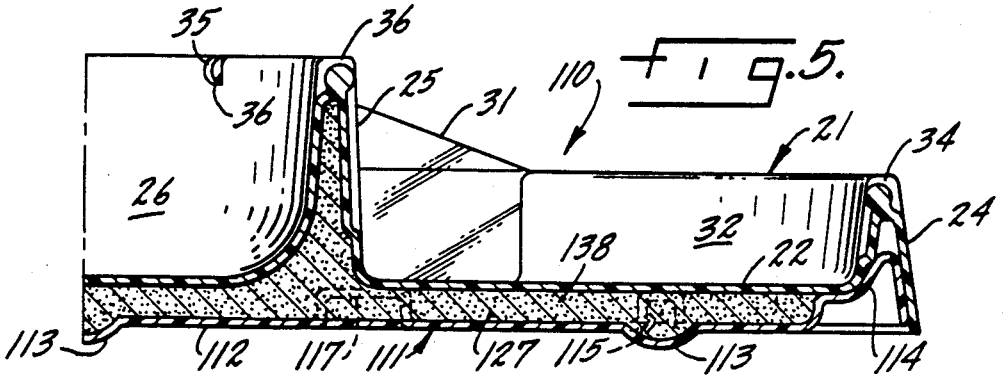
FIG. 5 is a sectional elevation view, like FIG. 2, of another embodiment of the invention, but showing only one-half of the chill-retention service tray.

FIGS. 5 and 6 illustrate the construction of a chill-retention service tray 110 that comprises another embodiment of the present invention. Tray 110 includes a bottom tray member 111 that may be formed of any suitable resin, usually by vacuum or extrusion molding. Polystyrene is preferred. As before, the thicknesses for the various parts of tray member 111 are not particularly critical. This tray member should be thick enough so that the overall construction of service tray 110 will be rigid and strong enough to withstand regular use. Typically, the walls and other elements of tray member 111 may have a thickness of approximately 0.060 inch 0.15 cm).

Bottom tray member 111, FIGS. 5 and 6, includes a bottom panel 112 of given size which, in this instance, has a circular configuration. The tray member includes a plurality of downwardly bulging support feet 113 and a peripheral bottom rim wall 114. Wall 114 is of generally U-shaped inverted configuration. The bottom tray member 111 also includes plurality of arcuate reinforcing ribs 115 and a broader group of arcuate indentations or ribs 117. All of the ribs 115 and 117 have approximately the same overall height, preferably about 0.375 inch (0.95 cm). There are passages 118 between ribs 115 and between ribs 117 as shown in FIG. 6.

The second major component of the chill-retention service tray 110 is a top tray member 21 that is the same, in its construction, as previously described. Thus, the two tray members 111 and 21 fit together, with their rim walls 24 and 114 engaging each other and preferably adhesively secured to each other. As before, tray 110 is provided with a plurality of removable partitions 31 that extend between the internal wall 25 of tray member 21 and its rim wall 24 (FIG. 5).

Tray members 21 and 111 conjointly define, between them, a main gel chamber 127 that is essentially similar to the previously described gel chamber 27A–27D. This main gel chamber 127 is in communication with the interior of the hollow internal wall 25 that forms cup 26 in the top tray member 21. Thus, when tray 110 is chilled for use, in a freezer, freezing of the gel 138 in chamber 127 causes the gel to expand upwardly into the space into wall 25 surrounding cup 26.

The use of chill-retention service tray 110, FIGS. 5 and 6, is the same as for tray 10 of FIGS. 1–4. Before the tray is used, the individual partitions or dividers 31 are removed. Tray 110 is then positioned in a freezer, in a horizontal orientation, for a period long enough to freeze the chillable gel 138 in main chamber 127. Subsequently, tray 110 is removed from the freezer and pre-chilled food and condiments are deposited in cup 26 and on support service 22. At this time, dividers 31 may be mounted in the tray to allow segregation of different foods in individual storage compartments 32, just as for the first-described embodiment of the invention. Any dip or relatively liquid food material is usually deposited in cup 26. The tray can then be set out and will keep its contents chilled for an extended time, up to five hours, even in a relatively warm environment. The preferred gel is the same as for tray 10.

FIGS. 7 and 8 illustrate another chill-retention service tray 210, intended primarily for single food service though adaptable to service of more than one food. Tray 210 includes a bottom tray member 211 of circular configuration, approximately 9 inches (22.8 cm) diameter with most of the area of tray member 211 constituting a flat bottom panel 212 (FIG. 7). The bottom tray member 211 is provided with a plurality of support feet 213 as shown in FIGS. 7 and 8 and a bottom rim wall 214 best illustrated in FIG. 7. As in the previously described embodiments, the rim wall 214 of the bottom tray member is hollow, being of inverted generally U-shaped configuration. Tray member 211 also includes a plurality of arcuate reinforcing ribs 215 with passages 218 between the ribs as shown in FIG. 8. There is a short horizontal flange 219 around the outside of bottom tray member 211; see FIG. 7.

Tray 210, FIGS. 7 and 8, includes a top tray member 221 of circular configuration, matching and interfitting with bottom tray member 211. Top tray member 221 includes a service support panel 222 that is supported upon the upper surfaces of reinforcing ribs 215 as shown in FIG. 7. There is a top rim wall 224 that fits closely onto and preferably is sealed to the bottom rim wall 214. A short flange 227, engaging flange 219, may also be utilized.

At one side of tray 210, its top tray member 221 includes a wall 225 of closed configuration encompassing a cup 226. Wall 225 may be hollow and in communication with the main gel chamber 227 between tray members 211 and 221, so that the wall affords an expansion volume for a chilling gel 238 that fills that main gel chamber 227.

Chill-retention tray 210, FIGS. 7 and 8, is intended primarily for individual servings. Cup 226 may be used for a dip or other semi-liquid food product, with the main surface of panel 222 used for storage of individual food elements. On the other hand, cup 226 may be employed, in a vehicular environment, as a support for a glass or a cup, with individual elements of a snack or meal stored in the balance of the tray. Tray 210 could be provided with one or more dividers like the dividers 31 of previously described embodiments; no dividers are shown in FIGS. 7 and 8. Use of tray 210 is essentially similar to previously described embodiments and requires no repetition. In some instances, it may be desirable to provide for replacement of the dip or other liquid or semi-liquid food product stored in the central cup of the chill-retention service tray, such as any one of the cups 26 and 226. To facilitate this kind of use for one of the serving trays, a simple cup insert 240, as shown in FIG. 9, may be employed. The cup insert is filled in a kitchen or like location and then exchanged for a depleted similar cup at the tray location.

We claim:

1. A chill-retention service tray capable of keeping its contents chilled for an extended time in a warm environment, comprising:

a bottom tray member including a bottom panel of given size and configuration, a bottom rim wall projecting upwardly from the periphery of the bottom panel, and at least one stiffening rib projecting upwardly to a predetermined level above a medial portion of the bottom panel;

a top tray member interfitting with and affixed to the bottom tray member, the top tray member including a service support panel positioned immediately above the top of the stiffening rib, a top rim wall projecting upwardly above the service panel and engaging the bottom rim wall around the periphery of the two panels, and an internal hollow wall, of closed configuration, projecting upwardly above the service panel;

the top and bottom tray members defining a main gel chamber, between them;

and a chilling gel filling the main gel chamber, the chilling gel having a high heat of fusion and a viscosity high enough to limit the gel sloshing about in the service tray when warm, yet liquid enough to be poured into the gel chamber.

2. A chill-retention serving tray according to claim 1 and further comprising:

a plurality of divider members, each extending across the support panel for the top tray member from the internal wall to the top rim wall, dividing the space between the internal wall and the top rim wall into a plurality of storage compartments.

3. A chill-retention serving tray according to claim 2 in which each divider member is a resin panel having mounting means at opposite ends removably engageable in any one of a series of pairs of retainer means, one retainer means of each pair being formed in the internal wall in alignment with the other retainer means of that pair, formed in the top rim wall.

4. A chill-retention serving tray according to claim 3 in which each retainer means, in the internal wall and in the top rim wall, is a slot in the top of the wall.

5. A chill-retention serving tray according to claim 3 in which each divider member panel has a concave bottom surface.

6. A chill-retention serving tray according to claim 1 in which one of the tray member walls is hollow defining a further gel chamber in communication with the main gel chamber.

7. A chill-retention serving tray according to claim 6 in which the hollow wall is the internal wall of the top tray member.

8. A chill-retention serving tray according to claim 6 in which the hollow wall is one of the rim walls.

9. A chill-retention serving tray according to claim 6 in which the hollow wall is the top rim wall.

10. A chill-retention serving tray according to claim 6 in which both rim walls are hollow and a further gel chamber is defined between them.

11. A chill-retention serving tray according to claim 1 in which all of the components of the service tray, other than the gel, are of molded resin.

12. A chill-retention serving tray according to claim 11 and further comprising:

a plurality of divider members, each extending across the support panel for the top tray member from the internal wall to the top rim wall, dividing the space between the internal wall and the top rim wall into a plurality of storage compartments.

13. A chill-retention serving tray according to claim 12 in which the divider member panels are removably mounted in the service tray and in which each divider member panel has a concave bottom surface.

14. A chill-retention serving tray according to claim 11 in which one of the walls is hollow, defining a further gel chamber, and the further gel chamber is in communication with the main gel chamber.

15. A chill-retention serving tray according to claim 1 in which the top and bottom tray members each include a peripheral flange and the two flanges are adhesively joined to seal the periphery of the gel chamber.

16. A chill-retention serving tray according to claim 15 in which all of the components of the service tray, other than the gel, are of molded resin.

17. A chill-retention serving tray according to claim 1 in which the internal wall is located in the central portion of the service panel.

18. A chill-retention serving tray according to claim 17 in which the internal wall has a height substantially greater than the top rim wall above the service panel.

19. A chill-retention serving tray according to claim 18 and further comprising:

a plurality of divider members, each extending across the support panel for the top tray member from the internal wall to the top rim wall, dividing the space between the internal wall and the top rim wall into a plurality of storage compartments.

20. A chill-retention serving tray according to claim 19 in which each divider member is a resin panel having mounting mean at opposite ends removably engageable in any one of a series of pairs of retainer means, one retainer means of each pair being formed in the internal wall in alignment with the other retainer means of that pair, formed in the top rim wall.

21. A chill-retention serving tray according to claim 20 in which each divider member panel has a concave bottom surface.

22. A chill-retention serving tray according to claim 18 in which one of the walls is hollow, defining a further gel chamber, and the further gel chamber is in communication with the main gel chamber.

23. A chill-retention serving tray according to claim 18 in which all of the components of the service tray, other than the gel, are of molded resin.

24. A chill-retention serving tray according to claim 1 in which the chilling gel is a water base gel including a quantity of cornstarch sufficient to afford a high viscosity precluding sloshing.

25. A chill-retention serving tray according to claim 1 in which the filling gel is:

| Constituent | Minimum | Maximum |
|---|---|---|
| water | 75% | 85% |
| acrylic polymer | 1% | 5% |
| potassium sorbale | 1% | 5% |
| sodium tetraborale | 0.1% | 0.5% |
| carboxymethylcellulose | 1% | 5% |
| propylene glycol | 10% | 20% |
| cornstarch | 5% | 10% |
| triethanolamine | 1% | 5% |

all stated percentages by weight.

26. A chill-retention service tray capable of keeping its contents chilled for an extended time in a warm environment, comprising:

a bottom tray member including a bottom panel of given size and configuration, a bottom rim wall projecting upwardly from the periphery of the bottom panel, and at least one stiffening rib projecting upwardly to a predetermined level above a medial portion of the bottom panel;

a top tray member interfitting with and affixed to the bottom tray member, the top tray member including a service support panel positioned immediately above the top of the stiffening rib, and a top rim wall projecting upwardly above the service panel, the top rim wall engaging and being adhesively joined to the bottom rim wall around the periphery of the two panels;

the top and bottom tray members defining a gel chamber, between them;

and a chilling gel filling the gel chamber, the chilling gel having a high heat of fusion and a viscosity high enough to limit the gel sloshing about in the service tray when warm, yet liquid enough to be poured into the gel chamber.

27. A chill-retention serving tray according to claim 26 in which the filling gel is:

| Constituent | Minimum | Maximum |
|---|---|---|
| water | 75% | 85% |
| acrylic polymer | 1% | 5% |
| potassium sorbale | 1% | 5% |
| sodium tetraborale | 0.1% | 0.5% |
| carboxymethylcellulose | 1% | 5% |
| propylene glycol | 10% | 20% |
| cornstarch | 5% | 10% |
| triethanolamine | 1% | 5% |

all stated percentages by weight.

* * * * *